United States Patent [19]

Grossmann et al.

[11] Patent Number: 4,479,555

[45] Date of Patent: Oct. 30, 1984

[54] POWER TOOL HAVING A PLASTICS MATERIAL HOUSING

[75] Inventors: Horst Grossmann, Huenfelden-Kirberg; Rolf Meier, Funkel; Karl Schmid, Idstein-Woersdorf, all of Fed. Rep. of Germany

[73] Assignee: Black & Decker Inc., Newark, Del.

[21] Appl. No.: 441,224

[22] Filed: Nov. 12, 1982

[30] Foreign Application Priority Data

Nov. 13, 1981 [GB] United Kingdom ..... 8134219

[51] Int. Cl.[3] ..... E02D 7/02

[52] U.S. Cl. ..... 173/171; 173/48; 408/56

[58] Field of Search ..... 173/94, 48, 90, 117, 173/170, 171; 310/62, 63; 408/56, 67, 68; 409/137

[56] References Cited

U.S. PATENT DOCUMENTS

| | | | |
|---|---|---|---|
| 2,546,846 | 3/1951 | Atkin | 310/62 |
| 3,818,255 | 6/1974 | Wagner | 310/62 |
| 3,829,721 | 8/1974 | Rosenthal, Jr. | 310/62 |
| 3,829,722 | 8/1974 | Rosenthal, Jr. et al. | 310/62 |
| 4,184,804 | 1/1980 | Inagaki et al. | 310/62 |

FOREIGN PATENT DOCUMENTS

| | | |
|---|---|---|
| 1427729 | 1/1969 | Fed. Rep. of Germany . |
| 6929672 | 7/1969 | Fed. Rep. of Germany . |
| 2533284 | 2/1977 | Fed. Rep. of Germany . |
| 1560420 | 2/1980 | United Kingdom . |
| 2050213 | 1/1981 | United Kingdom . |

*Primary Examiner*—Frank T. Yost
*Assistant Examiner*—Hien H. Phan
*Attorney, Agent, or Firm*—Harold Weinstein; Edward D. Murphy; Ronald B. Sherer

[57] ABSTRACT

A power tool having a plastics material housing and a power output spindle is provided with a tube-like metal member in the front end of the housing. A bearing is received within the tube-like member for supporting the spindle. The tube-like member has at the front end thereof radially outwardly extending tabs for dissipating heat therefrom. The tabs are preferably partially embedded in the plastics material of the front end of the housing for anchoring the member therein, alternate tabs preferably being angled rearwardly. The member may also support ratchet teeth of a hammer drill. A fan may be mounted on the spindle in the region of the front end of the member for facilitating dissipation of heat from the radial tabs.

13 Claims, 5 Drawing Figures

POWER TOOL HAVING A PLASTICS MATERIAL HOUSING

FIELD OF THE INVENTION

The present invention relates to power tools having a plastics material housing, and more particularly to hand-held power drills and the like.

BACKGROUND OF THE INVENTION

Various different types of power tools are known having a substantial portion of their outer casing formed from plastics material instead of metal in order to make the tool lighter and much easier to handle as well as being cheaper to produce and safer to use. Additionally, plastics material housings have advantages in that the tools can be made to look more aesthetically pleasing and free from sharp corners, and since the plastics material can be self-coloured by the addition of appropriate pigments to the polymeric material, painting is not necessary, so that the tool will retain a good appearance for the majority of its working life.

However, the disadvantage of a plastics material housing is that since the moving parts of the power tool can generate a considerable amount of heat, steps have to be taken in the design to ensure that the plastics material casing is protected from excessive heat, and various attempts have been made to overcome or avoid this problem.

In one example, it is known to provide a power tool having a metal casing, which is then coated in plastics material to give the appearance of the casing being made of plastics material while avoiding the problem of over-heating the plastics material. However such a solution is not particularly advantageous since it merely replaces the normal paint layer with a plastics material layer for the sake of appearances, the tool itself being basically unchanged and still having the disadvantages of being relatively heavy and more expensive to produce.

In German Gebrauchsmuster No. 6,929,672, there is disclosed a hand tool having a deformable plastics material barrel in which a metal tube is inserted for receiving the mechanism of the tool and providing the main strength of the barrel in use. In German Offenlegungschrift No. 2,533,284, a power tool is shown having a plastics material housing having a metal insert member incorporated therein for receiving a bearing in which the output spindle of the power tool is supported. Similarly, German Patent Specification No. 1,427,729 shows a power tool having a steel bushing provided in the front end of a plastics material housing of the power tool, which steel bushing has ratchet teeth provided thereon for enabling the tool to be utilised in a hammer drill mode. United Kingdom Patent Specification No. 1,560,420 discloses a metal sleeve in the plastic casing of a hammer drill. These arrangements indicate the basic idea of utilising a metal insert in a plastics material housing for the purpose of reinforcing the housing and for supporting or forming part of the mechanism of the power tool.

However, such known prior art arrangements have the disadvantages that they firstly require cast and/or machined metal inserts which generally have to be machined with precision and which are relatively expensive to produce. An assembly involves fitting the machined inserts into a pre-molded plastics material housing, which complicates assembly, and can increase manufacturing costs of assembly. Further, due to the heat generated during operation of the tool, problems can arise due to over-heating which can damage the plastics material housing and gradually loosen the metal insert therein, eventually resulting in a shortened working life of the tool; to avoid this, resort must often be made to bulkier components to dissipate the heat to avoid damage to the plastics material housing.

United Kingdom Patent Application No. 2,050,213 discloses a power tool having a load bearing structural foam housing closely surrounding a thin wall inner housing having improved heat conductivity in the region of the bearings. However, this inner housing encloses and extends around all the components of the power tool, and after the tool and the inner housing have been assembled, the outer foam housing has to be moulded around the assembled tool.

SUMMARY OF THE INVENTION

It is an object of the present invention to provide a reinforcing metal insert in the plastics material housing of a power tool which serves as a seating for metal components of the power tool and provides dissipation of heat therefrom at the front end of the power tool.

A feature by which this is achieved is the provision of radially outwardly extending tabs at the front end of the metal insert. These have the advantage of providing exterior dissipation of heat from the metal insert and of serving to anchor the insert in the tool housing.

Accordingly, there is provided by the present invention a power tool having a plastics material housing, a power output spindle, a tube-like metal member in the front end of the housing, and bearing means received within the tube-like metal member for supporting the spindle. The tube-like metal member has at the front end thereof radially outwardly extending portions for dissipating heat from said member.

The outwardly extending portions preferably comprise a plurality of tabs at least partially embedded in the plastics material of the front end face of the tool housing for anchoring the tube-like member therein.

To further aid heat dissipation, a fan may be mounted on the power output spindle to blow air outwardly over the outwardly extending tabs.

Preferably, the tube-like metal member is deep-drawn or pressed from sheet metal and may be provided with further means for enabling the sheet metal member to be more firmly secured in the plastics material housing against rotational and axial forces. This further securing means preferably comprises a plurality of arcuate slots in the sheet metal member into which the molten plastics material flows during production of the plastics material housing.

In addition to supporting and locating a bearing means for the power output shaft, in the case of a hammer drill, the tube-like metal member may also have ratchet teeth integrally formed thereon cooperable with ratchet teeth connected to the power output spindle or, alternatively, such ratchet teeth can be provided on a sintered metal insert which may be firmly located in the sheet metal member and cooperable with the ratchet teeth connected to the power output spindle. Heat generated by the ratchet teeth associated with the power output spindle of a hammer drill is dissipated along the power output spindle and through the chuck of the drill, while heat generated in the ratchet teeth provided on the tube-like metal member, or on an insert member inserted in the tube-like metal member, can be dissipated by means of the tube-like metal member.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

Figure 1:
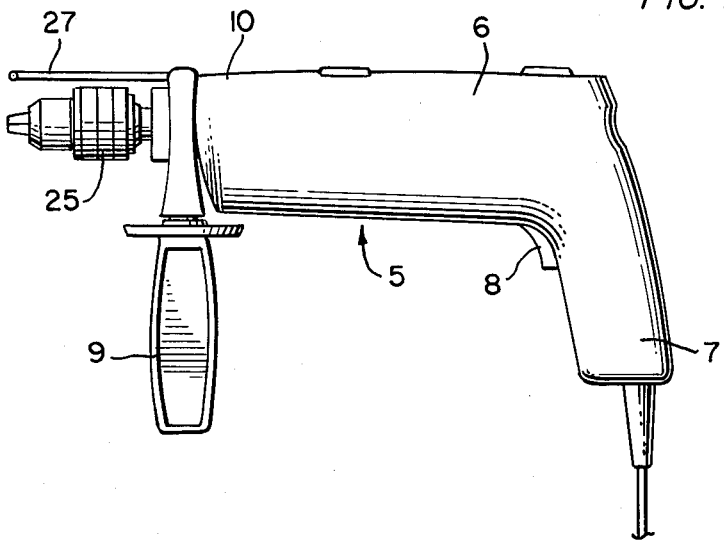
FIG. 1 is a diagrammatic elevational view of a hammer drill incorporating the invention.

FIG. 1 shows a portable power tool in the form of a hammer drill 5 having a motor compartment 6 containing an electric motor, a rear handle 7 with a trigger switch 8, and an auxiliary front handle 9 mounted about the front end of the power tool's plastics material housing 10.

Figure 2:
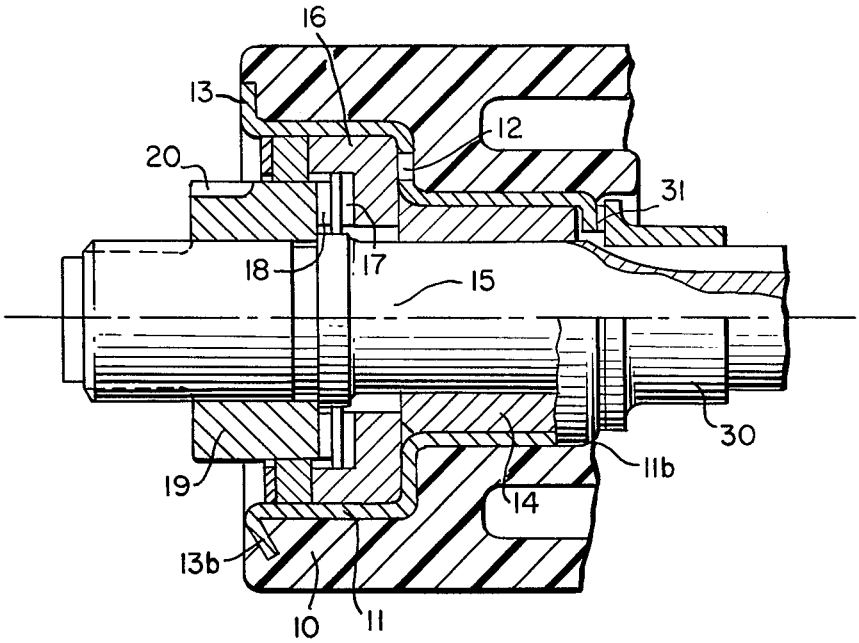
FIG. 2 is a diagrammatic longitudinal section of the front end of the hammer drill of FIG. 1, with the chuck and accessories omitted.

FIG. 2 shows, in section, the front end of the housing 10 in which is integrally moulded a guide tube 11 in the form of a tube-like metal member. The guide tube 11 is a deep drawn or pressed sheet metal member having a front cylindrical portion and a smaller diameter rear cylindrical portion connected by a stepped portion 11*a*. In the vertical wall of the stepped portion 11*a* are provided apertures 12 into which the plastics material of the housing 10 can flow during moulding, so as to provide a firm location for the sheet metal guide tube 11. Additionally, the front end of the metal guide tube 11 has bent-over, radially outwardly extending tab portions 13 which are at least partially embedded in the plastics material of the front end of the housing 10 to provide firm location of the guide tube 11 in the housing 10 while at the same time providing a forward facing surface to dissipate heat from the guide tube 11.

Located within the guide tube 11 is a bearing 14 for supporting the front end of the power output spindle 15 of the power tool, and the bearing 14 is firmly located in the guide tube suitably by means of serrations provided on the outer cylindrical surface thereof which bite into the inner wall of the guide tube 11 as a force fit. Additionally, an insert member 16, preferably made of a sintered metal and having forwardly facing ratchet teeth 17, is firmly seated in the guide tube 11, again by a force fit, serrations being provided on the outer surface of the member 16. The ratchet teeth 17 cooperate in a hammer drill mode of the power tool with rearwardly facing ratchet teeth 18 provided on a member 19 mounted on the spindle 15.

In the normal or drill mode of the hammer drill, the ratchet teeth 17 and 18 are held apart by means of suitable known mode selector means and therefore the only heat generated in such a drill mode is at the bearing 14. This heat is dissipated outwardly along the spindle 15, and also by the guide tube 11 to the tabs 13 exposed at the front end of the housing 10.

Figure 3:
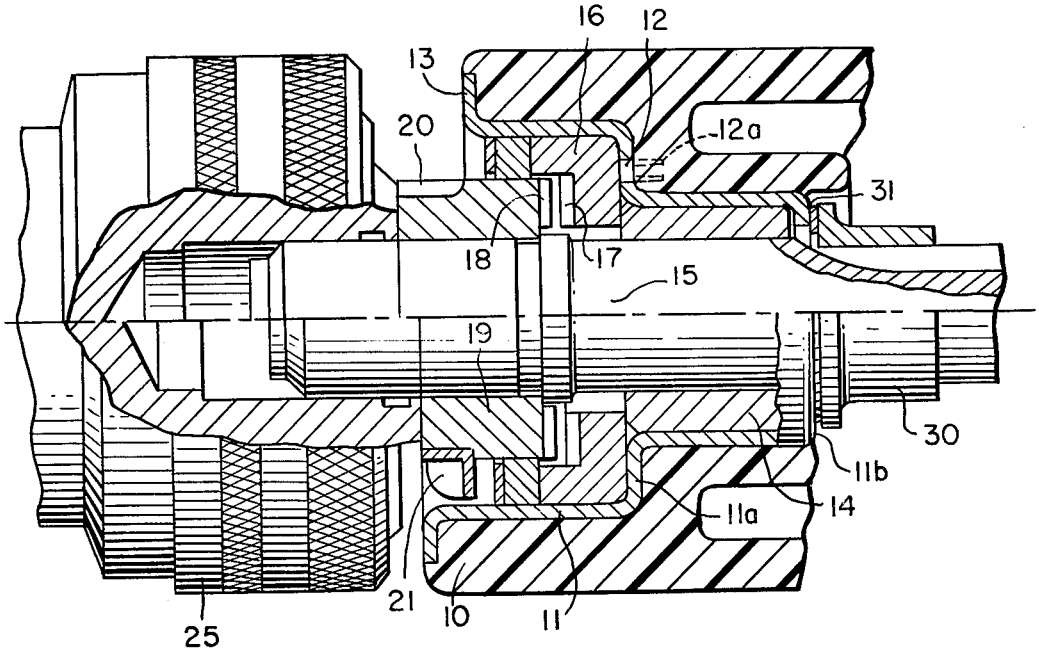
FIG. 3 is a similar view to FIG. 2, but including the chuck partly shown in elevation, and illustrating a modified fan arrangement in the lower half of the Figure.

To further improve heat dissipation by the tabs 13, fan means can be provided associated with the rotating spindle 15. In the arrangement of FIG. 3, two examples of suitable fan means are illustrated. In the upper portion of FIG. 3 the fan means is provided by a plurality of grooves 20 cut in the member 19, which, when the spindle 15 is rotating rapidly in use, blow air across the forwardly facing, external surfaces of the tabs 13 to increase and improve heat dissipation therefrom. This arrangement is also shown in FIG. 2. In the lower portion of FIG. 3, an alternative form of fan is shown which is provided as an attachment to the member 19 and is provided with two or more radially outwardly extending fan blades 21 which generate an adequate cooling draught to assist dissipation of heat from the forwardly exposed surfaces of the tabs 13 of the guide tube 11.

In the hammer mode of the hammer drill, when the ratchet teeth 17 and 18 are brought into engagement with one another, heat is also generated in the members 19 and 16. The heat generated in the member 19 is transmitted forwardly and outwardly via the spindle 15 and the chuck 25 (shown in FIGS. 1 and 3); while the heat generated in the member 16 or in the guide tube 11 itself, if the ratchet teeth are formed directly thereon, is dissipated to atmosphere by means of the tabs 13 of the guide tube 11.

Such an arrangement of the guide tube 11 enables heat to be dissipated rapidly, thereby preventing overheating of the guide tube and avoiding damage to the plastics material housing 10. The guide tube 11 is preferably more firmly secured in the plastics material housing 10 by the provision of tabs 12*a* (shown dotted in FIGS. 3 and 4*a*) provided in the region of the apertures 12, which tabs 12*a* extend into the plastics material of the housing 10 thereby providing a much more secure anchorage for the tube 11. Additionally, as shown in FIGS. 2 and 4*a*, alternate ones 13*b* of the tabs 13 may be angled rearwardly, preferably at an angle of 30° from the front plane of the housing 10, so that a large proportion of the alternate tabs 13*b* is embedded in the housing 10 during moulding, thereby providing a much more secure anchorage for the tube 11 and providing it with greater resistance to torque.

The innermost rear surface 11*b* of the guide tube 11 also provides a bearing surface for supporting a collar 30 mounted on the spindle 15 and secured thereto, which collar 30 prevents the spindle 15 being withdrawn from the front end of the housing 10. Between the rear wall surface 11*b* of the guide tube 11 and the collar 30, a bearing washer 31 is provided. Thus, the guide tube 11 fulfills a variety of functions, including providing appropriate seats for the bearing 14 and the ratchet teeth member 16, as well as dissipating heat generated in the bearing 14 and in the ratchet teeth 17, and provides a bearing surface for supporting the spindle 15. The guide tube acts to stabilize and reinforce the front-end of the tool, thereby facilitating use of the power tool with accessory attachments, such as the auxillary handle 9 and depth gauge 27 shown in FIG. 1, without danger of destroying the front end of the housing 10. This is especially true in cases where the hammer-drill is mounted in a drill stand which involves placing a band connection in surrounding relationship to the front end.

Figure 4A:
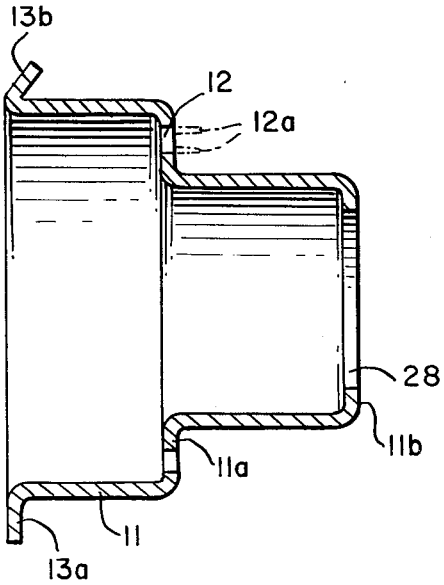
FIGS. 4*a* and 4*b* are a longitudinal section and a front elevational view, respectively, of the tube-like metal member which is inserted in the front end of the power tool of FIGS. 1 and 2.
Figure 4B:
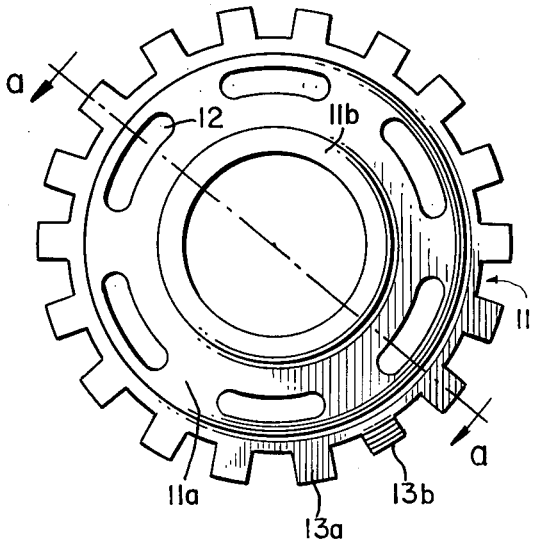

FIGS. 4*a* and 4*b* show the guide tube 11 in longitudinal section and in front view, respectively, from which the form of the tube-like metal guide member 11 can be clearly seen, FIG. 4*a* being a section on the line A—A of FIG. 4*b*. From these FIGS., the disposition of the radial tabs 13 can be clearly seen, alternate tabs 13*a* lying in a plane parallel to the front face of the housing 10 of the power tool, with the other alternate tabs 13*b* being angled rearwardly from such plane, preferably at an angle of 30°, although any other suitable angle may be utilised, so that these rearwardly angled tabs 13*b* are firmly embedded in the plastics material housing 10 during moulding thereof. FIG. 4*b* also clearly shows the shape of the apertures 12 which are arcuate slots provided in the step portion 11*a* of the guide tube 11. As mentioned earlier, rearwardly extending tongues 12*a* may be provided, as shown in dotted lines, to ensure a more positive anchorage in the plastics material housing 10. In the rearmost wall 11*b* of the guide tube 11, a central bore 28 is provided through which the power output spindle 15 of the power tool extends in the assembled tool. As can be seen from FIG. 4*b*, there are a plurality of diametrically disposed pairs of radial tabs 13*a*, 13*b*.

As can be appreciated from the above description, the present invention provides a simple and inexpensive guide tube member for reinforcing the front end of a plastics material housing of a power tool, and which member is capable of receiving other metal components and effectively dissipating heat generated therein or thereby, the guide tube member being integrally moulded in the plastic housing so as to be firmly anchored therein. A feature of the invention is the radially outwardly extending portions 13 having forwardly facing surfaces for the dissipation of heat.

The above described embodiments, of course, are not to be construed as limiting the breadth of the present invention. Modifications, and other alternative constructions, will be apparent which are within the spirit and scope of the invention as defined in the appended claims.

What is claimed is:

1. A power tool, comprising:
a plastics material housing;
a power output spindle;
a tube-like metal member integrally moulded in the front end of said housing;
a bearing received within said tube-like member and supporting said spindle; and
said tube-like member having at the front end thereof a plurality of radially outwardly extending tabs at least partially embedded in the plastics material of the front end of said housing for anchoring said tube-like member therein and for dissipating heat from said member and said bearing.

2. A power tool, comprising:
a plastics material housing;
a power output spindle;
a tube-like metal member in the front end of said housing;
bearing means, received within the tube-like metal member, for supporting said spindle;
said tube-like metal member having at the front end thereof radially outwardly extending portions for dissipating heat from said member; and
said outwardly extending portions comprising a plurality of tabs at least partially embedded in the plastics material of the front end of said housing for anchoring said tube-like member therein.

3. The power tool claimed in claim 2, wherein some of said tabs are angled rearwardly so that a large proportion of each rearwardly angled tab is embedded in said housing.

4. The power tool claimed in claim 2, wherein the power tool is a hammer drill, and ratchet teeth are associated with said tube-like metal member engageable with ratchet teeth provided on a member associated with said spindle to enable the power tool to operate in a hammer mode.

5. The power tool claimed in claim 4, wherein said ratchet teeth associated with said tube-like metal member are on an insert member firmly seated in said tube-like metal member.

6. The power tool claimed in claim 4, wherein the rear inner portion of said tube-like metal member provides a bearing surface, via the intermediary of a thrust bearing washer, for a collar mounted on said spindle.

7. A power tool, comprising:
a plastics material housing;
a power output spindle;
a tube-like metal member in the front end of said housing;
bearing means, received within the tube-like metal member, for supporting said spindle;
said tube-like metal member having at the front end thereof radially outwardly extending portions for dissipating heat from said member;
said tube-like metal member being formed from sheet metal; and
apertures are provided in said tube-like metal member and said member is integrally moulded in said front end of said housing whereby during the integral moulding of said tube-like metal member in said housing, plastics material flows into said apertures to anchor said tube-like metal member in said housing.

8. A power tool, comprising:
a plastics material housing;
a power output spindle;
a tube-like metal member in the front end of said housing;
bearing means, received within the tube-like metal member, for supporting said spindle;
said tube-like metal member having at the front end thereof radially outwardly extending portions for dissipating heat from said member; and
said tube-like metal member being a cup-shaped, stepped, sheet metal member.

9. The power tool claimed in claim 8, wherein arcuate slots are provided in the step portion of said tube-like metal member.

10. The power tool claimed in claim 9, wherein said slots are additionally provided with bent-over tabs for more securely anchoring said tube-like metal member in said housing.

11. A power tool, comprising:
a plastics material housing;
a power output spindle;
a tube-like metal member in the front end of said housing;
bearing means, received within the tube-like metal member, for supporting said spindle;
said tube-like metal member having at the front end thereof radially outwardly extending portions for dissipating heat from said member; and rotatable fan means associated with said spindle and located in the region of said front end of said tube-like metal member proximate a chuck of the power tool for facilitating dissipation of heat from said tube-like metal member.

12. A portable power tool comprising:

a plastics material housing;

a rotatable power output spindle;

a tube-like member of sheet metal integrally moulded in the front end of said housing;

bearing means, received within said tube-like member, for supporting said spindle;

said tube-like member having at the front end thereof a plurality of bent-over, outwardly extending tabs which are at least partially embedded in the plastics material of the front end of said housing to provide firm location of said tube-like member in said housing while at the same time providing forwardly facing external surfaces for dissipation of heat from said member; and a fan rotatable with said spindle and located in the region of the front end of said tube-like metal member for directing cooling air outwardly over said forwardly facing surfaces of said tabs to increase dissipation of heat from said tube-like metal member.

13. The power tool of claim 12, wherein said tube-like member is cup-shaped and stepped, and apertures are provided in the stepped part thereof whereby during the integral moulding of said tube-like member in said housing plastic material flows into apertures to further anchor said tube-like member in said housing, and wherein some of said outwardly extending tabs are angled rearwardly whereby a large portion thereof is embedded in said housing to increase the resistance to torque of said tube-like member.

* * * * *